US009093037B2

(12) United States Patent
Hsu et al.

(10) Patent No.: US 9,093,037 B2
(45) Date of Patent: Jul. 28, 2015

(54) METHOD AND ASSOCIATED APPARATUS FOR POWER-SAVING DISPLAY

(75) Inventors: Te-Wei Hsu, New Taipei (TW); Chuan-Tsung Chen, Taoyuan County (TW); Tung-Han Sung, New Taipei (TW)

(73) Assignee: MSTAR SEMICONDUCTOR, INC., Hsinchu County (TW)

( * ) Notice: Subject to any disclaimer, the term of this patent is extended or adjusted under 35 U.S.C. 154(b) by 374 days.

(21) Appl. No.: 13/445,015

(22) Filed: Apr. 12, 2012

(65) Prior Publication Data

US 2013/0147853 A1 Jun. 13, 2013

(30) Foreign Application Priority Data

Dec. 12, 2011 (TW) ..... 100145854 A

(51) Int. Cl.
*G09G 3/36* (2006.01)

(52) U.S. Cl.
CPC ..... *G09G 3/3611* (2013.01); *G09G 2320/064* (2013.01); *G09G 2320/0646* (2013.01); *G09G 2330/021* (2013.01); *G09G 2360/16* (2013.01)

(58) Field of Classification Search
CPC ..... G09G 3/3611
USPC ..... 345/102
See application file for complete search history.

(56) References Cited

U.S. PATENT DOCUMENTS

| | | | | |
|---|---|---|---|---|
| 8,358,264 | B2 * | 1/2013 | Nose et al. | 345/102 |
| 2009/0091528 | A1 * | 4/2009 | Hong | 345/102 |
| 2009/0284545 | A1 * | 11/2009 | Watanabe et al. | 345/589 |
| 2009/0304274 | A1 * | 12/2009 | Yoshii et al. | 382/167 |
| 2010/0245405 | A1 * | 9/2010 | Murai et al. | 345/690 |
| 2011/0157255 | A1 * | 6/2011 | Hsu et al. | 345/690 |

FOREIGN PATENT DOCUMENTS

TW 200917212 4/2009

OTHER PUBLICATIONS

Taiwan Patent Office, "Office Action", Dec. 12, 2013.

* cited by examiner

*Primary Examiner* — Kwang-Su Yang
(74) *Attorney, Agent, or Firm* — WPAT, PC; Justin King

(57) ABSTRACT

A method for power saving of display devices is provided. The method includes: while displaying a frame on a display, providing a representative data luma according to a plurality of original data lumas of a plurality of pixels of the frame, mapping a representative data luma value of a frame and a corresponding original drive value to a target display luma value according to the display characteristic, providing a power-saving data luma and a power-saving drive by mapping the target display value to a reference curve to display the frame.

28 Claims, 6 Drawing Sheets

V(Y) = ( DataL , PWM )

| PWM | DataL | Y |
|---|---|---|
| 100 | 255 | 255 |
| 90 | 255 | 221 |
| 80 | 255 | 194 |
| 70 | 255 | 164 |
| 60 | 255 | 133 |
| 50 | 255 | 100 |
| 50 | 240 | 93 |
| 50 | 224 | 82 |
| 50 | 208 | 70 |
| 50 | 192 | 59 |
| 50 | 176 | 50 |
| 50 | 160 | 42 |
| 50 | 144 | 34 |
| 50 | 128 | 27 |
| 50 | 112 | 22 |
| 50 | 96 | 16 |
| 50 | 80 | 12 |
| 50 | 64 | 8 |
| 50 | 48 | 4 |
| 50 | 32 | 2 |
| 50 | 16 | 0 |
| 50 | 0 | 0 |

PWM0 TR Y_th PWM _th

D_ max Y_th

| DataL \ PWM | 100 | 90 | 80 | 70 | 60 | 50 | 40 | 30 | 20 | 10 | 0 |
|---|---|---|---|---|---|---|---|---|---|---|---|
| 255 | 255 | 221 | 194 | 164 | 133 | 100 | 69 | 43 | 22 | 8 | 0 |
| 240 | 237 | 206 | 180 | 152 | 123 | 93 | 64 | 40 | 20 | 8 | 0 |
| 224 | 210 | 182 | 158 | 135 | 109 | 82 | 57 | 35 | 18 | 7 | 0 |
| 208 | 181 | 156 | 136 | 115 | 93 | 70 | 49 | 30 | 15 | 6 | 0 |
| 192 | 153 | 132 | 115 | 97 | 79 | 59 | 41 | 25 | 13 | 5 | 0 |
| 176 | 131 | 112 | 98 | 83 | 67 | 50 | 35 | 21 | 11 | 4 | 0 |
| 160 | 109 | 94 | 81 | 69 | 56 | 42 | 29 | 18 | 9 | 3 | 0 |
| 144 | 89 | 76 | 66 | 56 | 45 | 34 | 23 | 14 | 7 | 2 | 0 |
| 128 | 71 | 61 | 53 | 45 | 36 | 27 | 19 | 11 | 6 | 2 | 0 |
| 112 | 57 | 49 | 42 | 36 | 29 | 22 | 15 | 9 | 4 | 1 | 0 |
| 96 | 43 | 37 | 32 | 27 | 22 | 16 | 11 | 7 | 3 | 1 | 0 |
| 80 | 32 | 27 | 24 | 20 | 16 | 12 | 8 | 5 | 2 | 1 | 0 |
| 64 | 21 | 18 | 16 | 13 | 11 | 8 | 5 | 3 | 1 | 0 | 0 |
| 48 | 12 | 10 | 9 | 7 | 6 | 4 | 3 | 2 | 1 | 0 | 0 |
| 32 | 5 | 4 | 4 | 3 | 2 | 2 | 1 | 0 | 0 | 0 | 0 |
| 16 | 1 | 1 | 0 | 0 | 0 | 0 | 0 | 0 | 0 | 0 | 0 |
| 0 | 0 | 0 | 0 | 0 | 0 | 0 | 0 | 0 | 0 | 0 | 0 |

Y=L( DataL , PWM )

FIG. 5

PWM0

TR2

D_max

| DataL \ PWM | 100 | 90 | 80 | 70 | 60 | 50 | 40 | 30 | 20 | 10 | 0 |
|---|---|---|---|---|---|---|---|---|---|---|---|
| 255 | 255 | 221 | 194 | 164 | 133 | 100 | 69 | 43 | 22 | 8 | 0 |
| 240 | 237 | 206 | 180 | 152 | 123 | 93 | 64 | 40 | 20 | 8 | 0 |
| 224 | 210 | 182 | 158 | 135 | 109 | 82 | 57 | 35 | 18 | 7 | 0 |
| 208 | 181 | 156 | 136 | 115 | 93 | 70 | 49 | 30 | 15 | 6 | 0 |
| 192 | 153 | 132 | 115 | 97 | 79 | 59 | 41 | 25 | 13 | 5 | 0 |
| 176 | 131 | 112 | 98 | 83 | 67 | 50 | 35 | 21 | 11 | 4 | 0 |
| 160 | 109 | 94 | 81 | 69 | 56 | 42 | 29 | 18 | 9 | 3 | 0 |
| 144 | 89 | 76 | 66 | 56 | 45 | 34 | 23 | 14 | 7 | 2 | 0 |
| 128 | 71 | 61 | 53 | 45 | 36 | 27 | 19 | 11 | 6 | 2 | 0 |
| 112 | 57 | 49 | 42 | 36 | 29 | 22 | 15 | 9 | 4 | 1 | 0 |
| 96 | 43 | 37 | 32 | 27 | 22 | 16 | 11 | 7 | 3 | 1 | 0 |
| 80 | 32 | 27 | 24 | 20 | 16 | 12 | 8 | 5 | 2 | 1 | 0 |
| 64 | 21 | 18 | 16 | 13 | 11 | 8 | 5 | 3 | 1 | 0 | 0 |
| 48 | 12 | 10 | 9 | 7 | 6 | 4 | 3 | 2 | 1 | 0 | 0 |
| 32 | 5 | 4 | 4 | 3 | 2 | 2 | 1 | 0 | 0 | 0 | 0 |
| 16 | 1 | 1 | 0 | 0 | 0 | 0 | 0 | 0 | 0 | 0 | 0 |
| 0 | 0 | 0 | 0 | 0 | 0 | 0 | 0 | 0 | 0 | 0 | 0 |

Y=L( DataL , PWM )

FIG. 6

METHOD AND ASSOCIATED APPARATUS FOR POWER-SAVING DISPLAY

This application claims the benefit of Taiwan application Serial No. 100145854, filed Dec. 12, 2011, the subject matter of which is incorporated herein by reference.

BACKGROUND OF THE INVENTION

1. Field of the Invention

The invention relates in general to a power-saving display method and associated apparatus, and more particularly, to a power-saving display method and associated apparatus developed to avoid sacrificing display quality.

2. Description of the Related Art

Displays capable of presenting motionless and/or motion-laden frames have become one of the most important interfaces of modern electronic products. Displays, such as monitors, projectors and televisions, are widely applied in mobile phones, portable devices, computers, and audio-visual electronic equipment.

A display generally displays a frame with a panel (e.g., a liquid crystal display (LCD)) cooperating with a light source (e.g., a backlight source of a cathode ray tube (CRT) or of a light-emitting diode (LED)). A luminance (luma) presented by a display is directly associated with the luma presented by a panel. Regarding the luma of the panel, the frame consists of a plurality of pixels, and the panel includes a plurality of pixel units corresponding to the pixels. Each of the pixel units controls a transparency (transmittance) of the pixel unit with respect to the light source according to a corresponding luma value to control the luminance (luma) presented by the panel. For example, as the corresponding luma value transmitted to a specific pixel unit becomes larger, the transparency of the corresponding pixel unit gets higher for allowing more light beams provided by the light source to pass through the pixel unit, and thus a higher luma is presented. On the other hand, the brightness of the light source is also a factor that affects the luma presented by the display. For example, given that the luma value of a specific pixel unit is constant, the luma presented by the pixel unit gets higher as the brightness of the light source increases. In other words, the luma of the pixel units of the display are dependent on the luma values corresponding to the pixel units and the brightness of the light source.

Moreover, power consumed by the light source accounts for a large part in overall power consumption of the display. Therefore, overall power consumption may be effectively reduced by reducing power consumption of the light source to achieve power saving.

SUMMARY OF THE INVENTION

To reduce power consumption of display, thus achieving a power-saving display device and method, the invention appropriately amplifies luma values corresponding to pixel units of a display, so that a light source of the display is required to provide a lower brightness to reduce power consumption of the light source and further lower overall power consumption of the display.

In certain applications, an excessively low brightness of a light source affects a brightness distribution of the light source on a panel, such that the brightness is unevenly distributed to result in a light leakage. That is, when the brightness of the light source is too low, beams from the light source are leaked at edges of the panel to result in noticeable brightness differences at different positions of the panel. The light leakage degrades the quality of a displayed frame. Therefore, the present invention is directed to a power-saving technique as a solution to the light leakage issue, so as to attend to both frame quality and power saving requirements through eliminating the light leakage.

According to an object of the present invention, a method for power-saving display applied to a display is provided. The display has a display characteristic associating a data luma value and a drive value to a display luma value. The method comprises: providing a reference curve for associating the display luma value to a reference data luma value and a reference drive value; mapping a representative data luma value of a frame and a corresponding original drive value to a target display luma value according to the display characteristic; obtaining a power-saving data luma value and a power-saving drive value by mapping the target display luma value to the reference curve; and performing power-saving display of the frame according to a relationship between the power-saving data luma value and the representative data luma value.

In an embodiment, the maximum value of the original data luma values may be utilized as the representative data luma value. In another embodiment, the step of providing the representative data luma value comprises: performing a histogram counting, for decrementally sorting the original data luma values to a plurality of decremental bins; selecting a plurality of representative bins, each bin corresponding to a representative number, a number of the original data luma values accumulated from a highest bin to each of the representative bins matching the representative numbers corresponding to each of the representative bins; and providing the representative data luma value according to the original data luma values in the highest bin to each of the representative bins. For example, a corresponding quasi-representative data luma value is provided for each of the representative bins according to statistical characteristics (e.g., an average value or a minimum value) of the original data luma values in the highest bin to each of the representative bins. The representative data luma value is then provided according to the predetermined number of quasi-representative data luma values. For example, the representative data luma value is provided according to an average value of the predetermined number of quasi-representative data luma values.

In an embodiment, according to a difference between the power-saving drive value and a predetermined reduced drive value, a second power-saving drive value is provided for power-saving display of the frame.

In response to the light leakage, according to the present invention, a threshold drive value is provided according to the light leakage characteristics of the display, and the reference curve is provided according to the threshold drive value. For example, when the display characteristic maps a maximum luma value and the threshold drive value to a threshold display luma value, the reference curve associates the display luma value greater than the threshold display luma value to the maximum luma value, and associates the display luma value smaller than the threshold display luma value to the threshold drive value.

The reference curve may be a continuous line for associating different power-saving data luma values to different display luma values, so as to maintain a brightness gradient of the frame for attending to both power saving features and frame quality.

According to another object of the present invention, an apparatus for power-saving display applied to a display is provided. The apparatus comprises a representative data luma module, a reference curve module, a target display luma value module, a power-saving drive value module, a power-saving data luma value module, a histogram module, and an auto-mode control module. The representative data luma module provides a representative data luma value and a corresponding original drive value. The reference curve module provides a reference curve for respectively associating the display luma values to a reference data luma value and a reference drive value. The target display luma value module maps the original drive value and the representative data luma value to a target display luma value according to the display characteristic. The power-saving drive value module obtains a power-saving data luma value and a power-saving drive value by mapping the target display value to the reference curve. The power-saving data luma value module provides a relationship according to the power-saving data luma value and the representative data luma value for power-saving display of the frame.

The histogram module performs a histogram counting to sequentially sort the original data luma values to a plurality of decremental bins according to the values of the original data luma values. The auto-mode control module provides a concentration level according to the numbers of the original data luma values in the bins. The auto-mode control module utilizes a maximum value of the original data luma values as the representative luma data value when the concentration level satisfies a concentration condition, or else utilizes a value smaller than the a maximum value of the original data luma values as the representative luma data value when the concentration level does not satisfy the concentration condition.

For example, when the concentration level does not satisfy the concentration condition, it means the data luma module may select a predetermined number of representative bins. Further, according to statistical characteristics (e.g., an average value or a minimum value) of the original data luma values from the highest bin to each of the representative bins, the representative data luma module provides a quasi-representative data luma value for each of the representative bins, and provides the representative data luma value according to an average value of the predetermined number of quasi-representative data luma values.

The power-saving data luma value module provides a percentage according to a ratio between the power-saving luma value and the representative data luma value, and respectively provides a product of the percentage and the original data luma values for power-saving display of the frame.

In an embodiment, the power-saving drive value module further provides a second power-saving drive value according to a difference between the power-saving drive value and a predetermined reduced drive value for power-saving display of the frame.

In an embodiment, the reference curve further sets a threshold drive value according to the light leakage characteristic of the display, and provides the reference curve according to the threshold drive value. For example, when the display characteristic maps a maximum luma value and the threshold drive value to a threshold display luma value, the reference curve module associates by the reference curve the display luma value greater than threshold display luma value to the maximum luma value, and associates by the reference curve the display luma value smaller than the threshold display luma value to the threshold drive value.

The above and other aspects of the invention will become better understood with regard to the following detailed description of the preferred but non-limiting embodiments. The following description is made with reference to the accompanying drawings.

BRIEF DESCRIPTION OF THE DRAWINGS

FIG. 5 is an example of realizing the power-saving display technique according to an embodiment of the present invention.

FIG. 6 is a schematic diagram of a reference curve according to an embodiment of the present invention.

DETAILED DESCRIPTION OF THE INVENTION

Figure 1:
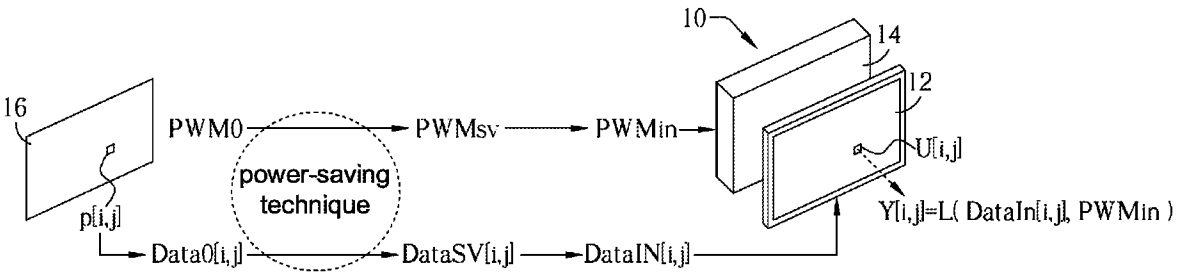
FIG. 1 shows a schematic diagram of an application of a power-saving display technique for a display according to an embodiment of the present invention.

FIG. 1 shows a schematic diagram of an application of a power-saving display technique to a display 10 according to an embodiment of the present invention. The display 10 comprises a panel 12 (e.g., an LCD) and a light source 14 (e.g., a backlight source). The panel 12 comprises a plurality of pixel units, which are indicated by a representative pixel unit U[i, j] in FIG. 1. Transparency (transmittance) of the pixel unit U[i, j] to the light source 14 is dependent on a corresponding input data luma DataIN[i, j], e.g., a Y component data (luminance) in a YCrCb color space. A brightness of the light source 14 is controlled by an input drive PWMin. For example, the brightness of the light source 14 can be controlled by a pulse width modulation (PWM) drive signal, with a size of a duty cycle of the drive signal representing a drive value of the input drive PWMin. As the drive value of the input drive PWMin increases, the duty cycle of the PWM signal gets larger and the brightness provided by the light source 14 to the panel 12 also increases.

The brightness actually presented at the pixel unit U[i, j] of the display 10 can be represented as a display luma value Y[i, j], which is dependent on the brightness of the light source 14 and the luma value of the corresponding input data luma DataIN[i, j]. Since the brightness provided by the light source 14 is controlled by the input drive PWMin, the display luma value Y[i, j] may be represented as a function of the input drive PWMin and the input data luma DataIN[i, j]: Y[i, j]=L (DataIN[i, j], PWMin), where the function L represents a luma display characteristic of the display 10. Different displays may have different display characteristics. In practice, by measuring display characteristics of the display 10, a conversion basis for subsequent luma/drive conversion may be established, e.g., a mapping table of display characteristics may be established.

A frame 16 presented at a display monitor includes a plurality of pixels. Operations of the pixels are substantially the same in the scope of the present invention, and in FIG. 1, a pixel p[i, j] is taken as a representative to demonstrate the operations. The pixel p[i, j] is associated with an original data luma Data0[i, j], which is a luma data of the pixel p[i, j]. When the display 10 displays the frame 16 with an original brightness of the light source, the pixel unit U[i, j] may be utilized to present the pixel p[i, j]. Thus, the original data luma Data0 [i, j] serves as the input data luma DataIN[i, j], and an original drive PWM0 corresponding to the original brightness of the light source serves as the input drive PWMin.

In the power-saving display technique applied to the display 10 according to one embodiment of the present invention, a corresponding power-saving data luma DataSV[i, j] and a corresponding power-saving drive PWMsv are provided according to the original data luma Data0[i, j] and the original drive PWM0 of the frame 16 to respectively replace the original data luma Data0[i, j] and the original drive PWM0. The display 10 consumes more power when displaying the frame 16 according to the original data luma Data0[i, j] and the original drive PWM0. In contrast, when the display 10 displays the frame 16 according to the power-saving data luma DataSV[i, j] and the power-saving drive PWMsv, the display 10 consumes less power, so as to achieve power saving during operation. More specifically, the power-saving drive PWMsv having a smaller luma value effectively reduces the power consumption of the light source 14 and thus further reduces the overall power consumption of the display 10. On the other hand, the power-saving data luma DataSV[i, j] having a greater luma value is capable of compensating luma loss of the pixel p[i, j] due to a dimmer light source 14. Therefore, to appropriately maintain a frame quality (e.g., the luma actually presented at the pixel p[i, j] by the pixel unit U[i, j] of the display, i.e., the display luma value Y[i, j], and/or an overall frame brightness gradient), the value of the power-saving data luma DataSV[i, j] may be greater than the value of the original data luma Data0[i, j], so that the drive value of the power-saving drive PWMsv may be smaller than the drive value of the original drive PWM0.

Figure 2:
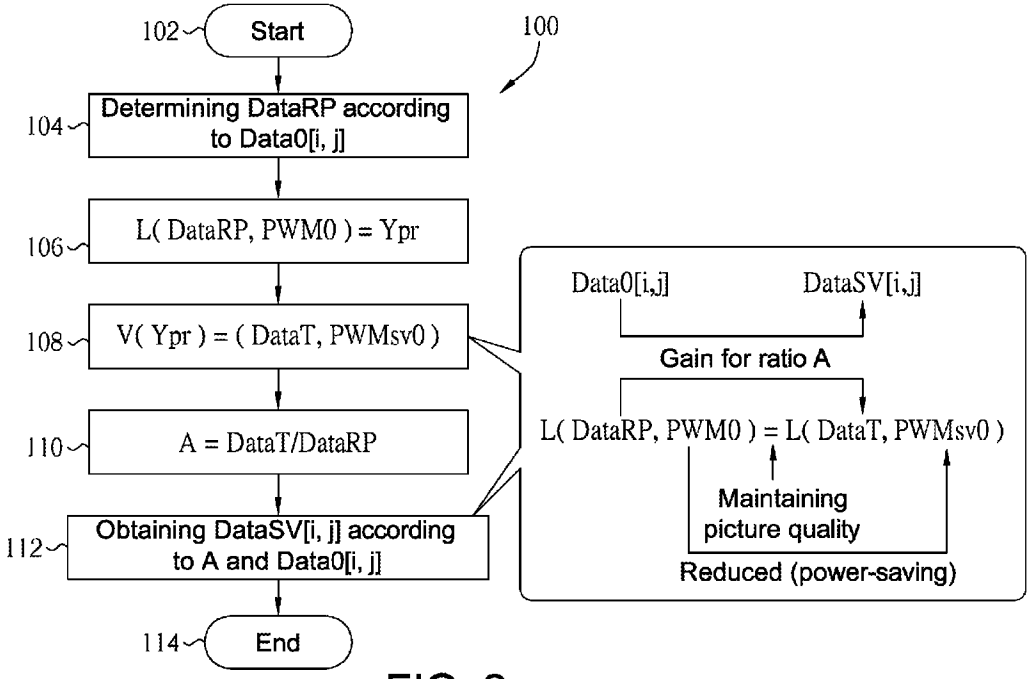
FIG. 2 is a flowchart of a process according to an embodiment of the present invention.

FIG. 2 shows a schematic diagram of a process 100 according to an embodiment of the present invention. The process 100 is applicable to the display 10 in FIG. 1 to implement the power-saving display technique of the present invention. Steps of the process 100 shall be described below.

In Step 102, the process 100 begins as the display 10 prepares to display a frame 16.

In Step 104, a plurality of original data lumas Data0[i, j] of a plurality of pixels of the frame 16 are received, and a representative data luma DataRP is provided according to the original data lumas Data0[i, j]. Since the display 10 is composed of the panel 12 comprising a plurality of pixel units U[i, j] and the light source 14, for a plurality of input data lumas DataIN[i, j], the light source 14 is only able to provide a single luma corresponding to a same input drive PWMin. Therefore, before calculating the input drive PWMin for replacing the original drive PWM0, a single representative data luma DataRP is to be calculated or selected from the original data luma Data0[i, j], so as to allow the present invention to obtain the corresponding single input drive PWMin in response to the single representative data luma DataRP. According to the single input drive PWMin, the new input data luma DataIN[i, j] corresponding to the pixels p[i, j] can be deduced. Details of the remaining steps shall be given as follows. In Step 104, the representative data luma DataRP is determined in several modes. In an embodiment, in a frame quality mode, the original data luma having the largest luma value is selected as the representative data luma DataRP from the original data lumas Data0[i, j] of the frame 16, i.e., the representative data luma DataRP directly equals the maximum value Data0_max of the original data lumas Data0[i, j]. In another embodiment, in a power-saving mode, the representative data luma DataRP is determined according to a predetermined statistical characteristic of all the original data lumas Data0[i, j]. In the power-saving mode, the representative data luma DataRP is smaller than the maximum original data luma Data0_max. An embodiment in which the representative data luma DataRP is selected in a power-saving mode shall be discussed below.

Figure 3:
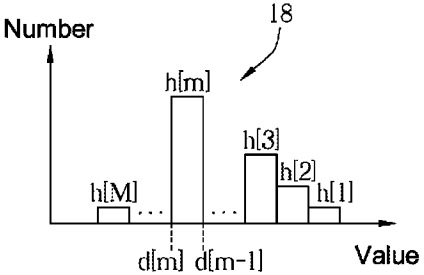
FIG. 3 is a histogram according to an embodiment of the present invention.

FIG. 3 shows a method for determining the representative data luma according to an embodiment of the present invention. In Step 104, a histogram counting 18 is performed on a plurality of original data lumas Data0[i, j] of the frame 16 to sequentially sort the original data lumas Data0[i, j] to a plurality of decremental bins h[1], h[2], . . . , h[m] to h[M], where M is a predetermined integer. For example, the bin h[m] may be associated with a predetermined luma value range d[m−1] to d[m], and may be further numerically adjusted. For example, an original data luma Data0[i0, j0] having a value smaller than the luma value d[m−1] and greater than the luma value d[m], the original data luma Data0[i0, j0] may be classified into the bin h[m]. In this embodiment, the maximum original data luma value Data0_max is classified into the highest bin h[1].

Figure 4:
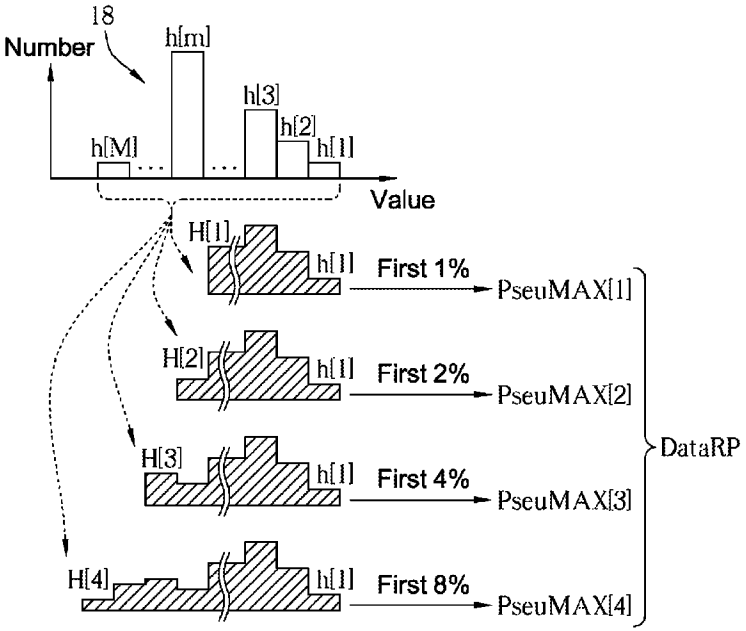
FIG. 4 is a schematic diagram of a power-saving mode according to an embodiment of the present invention.

In the power-saving mode, from the bins h[1] to h[M], K number of representative bins H[1] to H[K] may be further selected, with each representative bin H[k] corresponding to a representative number Nr[k], where k ranges from 1 to K. The number of original data lumas Data0[i, j] accumulated in the highest bin h[1] to the representative bins H[k] matches the representative number Nr[k] corresponding to the bins H[k]. For example, assuming the frame 16 includes N number of original data lumas Data0[i, j], the representative number Nr[k] may be equaled to a predetermined percentage of N. When the number of original data lumas accumulated in the bins h[1], h[2] to h[m] matches the representative number Nr[k] (e.g., the accumulated number is closest to the representative number Nr[k] and is not smaller than representative number Nr[k]), the bin h[m0] is selected as a representative bin H[k]. For example, as shown in FIG. 4, in an embodiment, K may equal 4, and Nr[1] to Nr[4] may respectively equal N*1/100, N*2/100, N*4/100 and N*8/100. That is, after decrementally sorting all the N number of original data lumas Data[i, j], the highest bin h[1] to the bin corresponding to the first representative bin H[1] cover the first 1% of luma values of the original data lumas Data0[i, j], and the highest bin h[1] to the bin corresponding to the fourth representative bin H[4] cover the first 8% of luma values of the original data lumas Data0[i, j].

According to statistical characteristics of the original data luma Data0[i, j] in the representative bins H[1] to H[K], the representative data luma DataRP is provided for the power-saving mode. For example, a corresponding quasi-representative data luma PseuMAX[k] is respectively provided for the representative bins H[k] according to the statistical characteristics of the original data lumas Data0[i, j] in the bins h[1] to the representative bins H[k]. For example, the quasi-representative luma data PseuMAX[k] may be an average value or a minimum value of all the original data lumas Data0[i, j] in the bin h[1] to the representative bins H[k]. Furthermore, the representative data luma DataRP under the power-saving mode may be provided according to the quasi-representative data lumas PseuMAX[1] to PseuMAX[K]. For example, the representative data luma DataRP is set to equal an average value of the quasi-representative data lumas PseuMAX[1] to PseuMAX[K]. The representative data luma DataRP in the power-saving mode may be smaller than the maximum original data luma value Data0_max.

In addition to the above embodiments, which provide only two modes, the frame quality mode and the power-saving mode, for setting the representative data luma DataRP, another embodiment provides an option for user of selecting the mode for setting the representative data luma DataRP in Step 104. In yet another embodiment, a concentration level may be dynamically generated according to the number of the original data lumas Data0[i, j] in the bins h[1] to h[M]. The representative data luma DataRP is set according to the frame quality mode when the concentration level satisfies a predetermined concentration condition; that is, the maximum original data luma value Data0_max serves as the representative data luma DataRP. Conversely, the representative luma data DataRP is set according to the power-saving mode when the concentration level does not satisfy the concentration condition; that is, the representative data luma DatRP is set to be smaller than the maximum original data luma value Data0_max. In an embodiment, whether the concentration level satisfies the concentration condition may be dependent on whether the number of the original data lumas Data0[i, j] accumulated in a predetermined of neighboring bins is greater than a predetermined concentration accumulated number. The predetermined concentration accumulated number may be a predetermined percentage of the total number N. In other words, during the process 100 performed on different frames 16, the representative data luma DataRP corresponding to the different frames may be set by selecting different modes according to the concentration levels of the different frames, respectively.

When the concentration condition is satisfied, this indicates that differences between the luma values of majority of the original data lumas Data0[i, j] are small and the majority of the original data lumas Data0[i, j] concentrate around a particular luma value. For example, for a blank frame, maintaining minimal luma distortion is an issue in displaying. Therefore, the frame quality mode is selected for setting the representative data luma DataRP so that the brightness gradient levels of the frame stay uncompressed. In contrast, when a frame fails to meet the concentration condition, this indicates that the frame has more and obvious brightness variations in a way that slight luma distortion is unlikely to be perceived by a viewer of the frame, and the power-saving mode may be selected for setting the representative data luma DataRP to enhance power-saving effects.

In another embodiment, when defining the concentration condition, a standard deviation or a similar statistical characteristic of all the original data lumas Data0[i, j] may be introduced for assessing the concentration level of the original data lumas Data0[i, j]. For example, compared to the brightness luma range d[m−1] to d[m] of the bins h[m], it is determined that the concentration condition is satisfied when a ratio of dividing the standard deviation by the luma data range |d[m−1]-d[m]| is smaller than a predetermined ratio.

Thus, the luma value of the representative data luma DataRP is set in Step 104. In Step 106, according to the drive value of the original drive PWM0 and the luma value of the representative luma DataRP, a corresponding display luma Y=L(DataRP, PWM0) is mapped from a display characteristic function L to serve as a target display luma value Ypr. That is, Ypr=L(DataRP, PWM0). With reference to FIG. 1, in equivalence, if the display 10 drives the light source 14 by the original drive PWM0 and the representative data luma DataRP serves as the input data luma DataIN[i, j] of a pixel unit U[i, j], the display luma presented by the pixel unit U[i, j] equals the target display luma YPr. In practice, the display characteristic function L, measured in advance, may be presented by a mapping table with details thereof to be described below.

FIG. 5 shows a schematic diagram of a display characteristic function L associating luma values DataL of 0 to 255 and drive values of 0 to 100 to corresponding display luma values Y utilizing a mapping table according to an embodiment of the present invention. In this embodiment, an original drive PWM0 corresponds to the drive value PWM, and an original data luma Data0[i, j] and a representative data luma DataRP correspond to the luma value DataL. In FIG. 5, combinations of drive values PWM 0, 10, 20, 30, 40, 50, 60, 70, 80, 90, and 100, and luma values DataL 255, 240, 224, 208, 192, 176, 160, 144, 128, 112, 96, 80, 64, 48, 32, 16, and 0 are utilized for illustrating how the display characteristic function L associates the luma values DataL of 0 to 255 and the drive values of 0 to 100 to corresponding display luma values Y. For example, as shown in FIG. 5, when the drive value PWM and the luma value DataL are respectively 100 and 255, the luma displayed on the display 10 is the highest with a display luma value standardized as 255. When the drive value PWM and the luma value DataL are respectively 100 and 128, the display luma value Y decreases to 71. For the drive value PWM and the luma value DataL respectively being 70 and 255, the display luma value Y is 164. Different combinations of the drive value PWM and the luma value DataL may correspond to a same display luma value Y. For example, when the drive value PWM and the luma value DataL are respectively 70 and 160, the display luma value Y is 69; when the drive PWM and the luma value DataL are respectively 40 and 255, the display luma value Y is also 69.

In Step 108, the target display luma value Ypr in Step 106 is substituted into a reference curve V to obtain a set of corresponding luma value and drive value, which respectively serve as a reference data DataT and a power-saving drive PWMsv0. The reference curve V(Y) associates each of the display luma values Y to a corresponding luma value DataL and a corresponding drive value PWM. That is, V(Y)=(DataL, PWM). Referring to the embodiment in FIG. 5, in the display characteristic function L, a set of luma value DataL and drive value PWM only correspond to a specific display luma value Y. However, the display luma value Y may correspond to more than one set of luma value DataL and drive value PWM. Therefore, the reference curve V is a function fitting the display characteristic function L of the mapping table for associating each of the display luma values Y to a specific luma value DataL and a specific drive value PWM. In Step 108, the reference curve V is defined, and the target display luma value Ypr is substituted into the display luma value Y, so that the input data luma value DataL and the drive value PWM associated with V(Ypr) are respectively the reference input data luma DataT and the power-saving drive PWMsv0.

Regarding the definition for the reference curve V, when the power-saving display of the present invention is not currently adopted, the display 10 usually generates luma with the original drive PWM being the maximum drive value of 100. Referring to FIG. 5, given that the original drive PWM is 100, the relationship between the input data luma and the display luma is L(DataL, 100)=Ya. For example, L(176, 100)=131. In this embodiment, the reference curve V(Y) may be defined as follows. In the mapping table L(DataL, PWM)=Y of the display characteristic of the display 10, Q number of combinations of the luma value and the drive value (Data[1], PMW[1]), (Data[2], PMW[2]), . . . , (Data[ ], PMW[q]) to (Data[Q], PMW[Q]) are associated to a single display luma value Ya (i.e., L(Data[q], PWM[q])=Ya for q=1 to Q) via the display characteristic function L. Thus, from the Q number of sets of combinations (Data[1], PWM[1]) to (Data[Q], PWM[Q]), one set (Data[qs], PWM[qs]) is selected so that the display luma value Ya maps to a specific set of luma value and drive value for setting the reference curve V. That is, V(Ya)=(Data[qs], PWM[qs]). In other words, when the combinations (Data[1], PWM[1]) to (Data[Q], PWM[Q]) respectively serve as the input data luma DataIN[i, j] and the input drive PWMin, the display 10 displays the same display luma value Ya; wherein, the drive value PWM[qs] of the combination (Data[qs], PWM[qs]) is the smallest drive value, minimizing power consumption. Correspondingly, the luma value Data[qs] may be the largest luma value among Data[1] to Data[Q]. In an embodiment, taking the display value Ya=131 generated based on the drive PWM being 100 for example, a display luma approximated to or equaled to Ya=131 is identified from the mapping table (e.g., as shown in FIG. 5) of the display characteristic of the display 10. From FIG. 5, the combinations (192, 90)=132, (208, 80)=136, (255, 60)=133 . . . etc. are obtained. For the PWM of 60, a matching (approximate) display luma 133 is available, and so the input data luma 255 is regarded as a corresponding value for establishing the reference curve V. In this embodiment, the input data corresponding to the reference curve is obtained through the approach of identifying a value most approximated to the original display luma. In other embodiments, the minimum drive and input data luma corresponding to the original display luma may be obtained through interpolation.

Further, when establishing the reference curve V, light leakage may also be taken into consideration. Since the light leakage results from a brightness of the light source 14 being lower than a given threshold, not only should the brightness of the light source 14 ought to have a lower brightness limit, but also the drive value of the input drive PWM correspondingly ought to have a minimum value as the threshold drive value PWM_th, in order to avoid or eliminate the light leakage. Therefore, when establishing the reference curve V, to select one of the combinations (Data[1], PWM[1]) to (Data[Q], PWM[Q]) of a same display luma value Ya, the reference curve V(Ya) may be associated to the combination (Data_Ya, PWM_th) when the smallest drive value among the drive values PWM[1] to PWM[Q] is already smaller than the threshold drive value PWM_th, in a way that the luma value Data_Ya allows L(Data_Ya, PWM_th)=Ya. In contrast, when the smallest drive value PWM[qs] is still greater than the threshold drive value PWM_th, the reference curve V may still associate the display luma value Ya to the combination (Data[qs], PWM[qs]).

Similarly, in the embodiment shown in FIG. 5, the drive value of the original drive PWM0 is 100, and the threshold drive value PWM_th (referring to Step 108) for avoiding the light leakage is assumed to be 50. The maximum data value D_max equals 255. A track TR is thus formed by the luma value and the drive value associated with the reference curve V(Y). Since the display characteristic function L associates the drive threshold PWM_th (having a value of 50 in this embodiment) and the maximum luma value D_max (having a value of 255) to the display luma value Y having a value of 100, the value 100 is defined as a threshold display luma value Y_th. As shown in FIG. 5, in this embodiment, following the horizontal line of the luma value DataL equaled to the maximum luma value D_max, the reference curve V associates the display luma value Y greater than the threshold display luma value Y_th to the maximum luma value D_max. That is, V(Y)=(D_max, PWM_hrz), where Y>Y_th, and the drive value PWM_hrz satisfies L(D_max, PWM_hrz)=Y. Further, the track TR becomes vertical where the display luma value Y equals the threshold display luma value Y_th, and the horizontal line having the drive value PWM equaled to the threshold drive value PWM_th associates the display luma value Y smaller than the threshold display luma value Y_th to the threshold drive value PWM_th. That is, V(Y)=(Data_vrt, PWM_th), where Y<Y_th, and the luma value Data_vrt satisfies L(Data_vrt, PWM_th)=Y.

For example, when the output Y respectively equals 255, 221, 194, 164, and 133, and is greater than the threshold display luma value Y_th (=100), the reference curve V(Y) respectively obtains the luma value and drive value combinations (255, 100), (255, 90), (255, 80), (255, 70), and (255, 60). In these combinations, the luma value DataL is equaled to the maximum luma value D_max. When the output Y respectively equals 93, 59, and 34, and is smaller than the threshold display luma value Y_th (=100), the drive value PWM is equaled to the threshold drive value PWM_th (=50).

In Step 110, a ratio A is provided according a ratio DataT/DataRP of the reference data DataT (obtained in Step 108) and the representative data luma DataRP (obtained in Step 104). For example, A=DataT/DataRP.

In Step 112, a corresponding power-saving data luma DataSV[i, j] is provided according to a product of the ratio A in Step 110 and the original data luma DataIN[i, j]. For example, the ratio A may equal DataT/DataRP, and the power-saving data luma DataSV[i, j] may be A*DataIN[i, j]. Moreover, the power-saving drive (in FIG. 1) may be provided according to the power-saving drive PWMsv0 in Step 108. In an embodiment, Step 110 may provide a power-saving drive PWMsv under a normal power-saving mode; the power-saving drive PWMsv under the normal power-saving mode equals the power-saving drive PWMsv0. Alternatively, Step 110 may provide a power-saving drive PWMsv under a reinforced power-saving mode. Under the reinforced power-saving mode, the power-saving drive PWMsv may be provided according to a difference (PWMsv0−dPWM) between the power-saving drive PWMsv0 and a predetermined reduced drive dPMM. For example, PWMsv=(PWMsv0−dPWM). Alternatively, in another embodiment of the reinforced power-saving mode, the power-saving drive PWMsv may also equal to a product Ap*PWMsv0, where the ratio Ap is a predetermined value smaller than 1.

In Step 114, the power-saving drive PWMsv and the power-saving data luma DataSV[i, j] are respectively substituted into the input drive PWMin and the input data luma DataIN[i, j] to display the frame 16 and finish the process 100. Accordingly, the power-saving display technique is implemented to achieve the frame quality while avoiding light leakage.

The process 100 performed with the display characteristic function L and the reference curve V is summarized as follows. From all the original data lumas Data0[i, j] of the frame 16, the largest value is selected as the representative data luma DataRP (Step 104). Assuming the representative data luma DataRP of the frame 16 equals 208 and the drive value of the original drive PWM0 is 100, it is mapped according to the display characteristic function L that the corresponding display luma value Y is 181 when the luma value DataL is 208 and the drive value PWM is 100. That is, the target display luma value Ypr=181 (Step 106). The target display luma value Ypr=181 is substituted into the reference curve V, and it is determined that the corresponding luma value DataL and drive value PWM are respectively 255 and 75 (the value 75 is obtained by interpolating values 80 and 70). That is to say, the reference data DataT and the power-saving drive PWMsv0 are respectively 255 and 75 (Step 108). According to the reference data dataT and the representative data luma DataRP, it is obtained that A=DataT/DataRP=255/208 (Step 110). Thus, the power-saving data luma DataSV[i, j] and the power-saving drive PWMsv are provided according to DataSV[i, j]=A*Data0[i, j] and PWMsv=PWMsv0 (Steps 112 and 114, and FIG. 1). Originally, the display 10 displays the frame 16 according to the original data luma Data0[i, j] and the original drive PWM0. However, when the display 10 alternatively presents the frame 16 according to the power-saving data luma DataSV[i, j] and the power-saving drive PWMsv, since the power-saving PWMsv=75 is smaller than the original drive PWM0=100, the frame quality (e.g., a brightness gradient) is upheld while achieving power saving. Through the gain of the ratio A, the power-saving data luma DataSV[i, j] is greater than the original data luma Data0[i, j] to compensate the lower power-saving drive PWMsv to further maintain the frame quality of the displayed frame. For example, the maximum value of the original data lumas Data0[i, j] is 181, and the maximum value of the power-saving data luma DataSV[i, j] is increased up to 255 (i.e., the maximum value of the luma value DataL) through the gain provided by the ratio A. Therefore, a reduction from the original drive PWM0 to the power-saving drive PWMsv is the largest. Moreover, light leakage is prevented as contributed by the power-saving drive PWMsv=75 that is yet greater than the threshold drive value PWM_th.

Advantages of the present invention are disclosed by the process 100. As shown in FIG. 2, in consideration of the light leakage, through the target display luma value Ypr, the reference curve V associates the representative data luma DataRP (corresponding to the original data luma Data0[i, j]) and the original drive PWM0 to the reference data DataT (corresponding to the power-saving data luma DataSV[i, j]) and the power-saving drive PWMsv0 with the same display luma value. The frame quality is maintained as a result of the same display luma value. Further, the luma value of the representative data luma DataRP is lower than the reference data DataT, and so the power-saving drive PWMsv0 is lower than the original drive PWM0 for power saving.

For a series of a plurality of frames to be displayed by the display 10, e.g., a plurality of frames of a dynamic image, the process 100 is respectively performed on the frames, so as to adaptively obtain different power-saving drives PWMsv, different ratios A and corresponding power-saving data lumas for the different images.

For another example, when the representative data luma DataRP of the frame 16 equals 112, the target display luma value Ypr having a value of 57 is displayed with the original drive PWM0. That is, L(112, 100)=57. From the reference curve V, it is mapped that V(57)=(189, 50); that is, the reference data DataT=189. The ratio A is accordingly obtained as A=DataT/DataRP=189/112. Therefore, the original data luma Data0[i, j] may be amplified to a larger power-saving data luma DataSV[i, j] by multiplying with the ratio A, while the power-saving drive PWMsv is correspondingly lowered from the higher power-consuming original drive PWM0=100 to the lower power-consuming power-saving drive PWMsv0=50. It is concluded from the display characteristic L that, by amplifying the representative data luma DataRP to the maximum luma value D_max (i.e., 255), the corresponding drive PWM is reduced to around 35 (i.e., L(255, 35)=L(112, 100)=57). However, the drive PWM=35 is lower than the threshold drive value PWM_th (which is 50 in this embodiment). Consequently, when the display luma value Y is smaller than the threshold display luma value Y_th of light leakage, the reference curve Y in FIG. 5 fixedly associates the power-saving drive PWMsv0 to the threshold drive value PWM_th to prevent the light leakage.

When amplifying the original data luma Data0[i, j] to the power-saving data luma DataSV[i, j] with the ratio A (DataSV[i, j]=A*Data0[i, j], in Step 112), for the original data luma Data0[i, j] corresponding to red, green, and blue color components R[i, j], G[i, j], and B[i, j] in an RGB color space, red, green, and blue color components of the power-saving data luma DataSV[i, j] are respectively components A*R[i, j], A*G[i, j], and A*B[i, j]. For original data luma Data0[i, j] corresponding to components Y[i, j], Cb[i, j], and Cr[i, j] in a YCbCr color space, components Y, Cb, and Cr corresponding to the power-saving data luma DataSV[i, j] are respectively A*Y[i, j], Cb[i, j], and Cr[i, j], with only the luma component Y[i, j] being amplified.

FIG. 6 shows a schematic diagram of a track TR2 for defining the reference curve V according to another embodiment of the present invention. As shown by the track TR2, the reference curve V includes several turning points that divide the reference curve V into several horizontal and/or vertical sections. In each horizontal section, the reference curve V maps different display luma values Y to a same luma value DataL but to different drive values PWM. For example, in the horizontal section between display luma values Y=255 to 194 of the track TR2, different display luma values Y are mapped to a same luma value DataL=255. However, the drive value PWM changes from 100 to 80 as the display luma value Y changes from 255 to 194. Similarly, in the horizontal section between display luma values Y=158 to 109, different display luma values Y are mapped to a same luma value DataL=224, with the associated drive value PWM however changing from 80 to 60. Further, in every vertical section, the reference curve V maps different display luma values Y to a same drive value PWM but to different luma values DataL. For example, between the display luma values Y=194 to 158, the track TR2 appears as a horizontal section. In this horizontal section, different display luma values Y are mapped to a same drive value PWM=80, and the luma value DataL however changes from 255 to 224 as the display luma value Y changes from 194 to 158.

When establishing the reference curve V by use of the display characteristic function L, the reference curve V may be a slant line, a curve, or a line consisted of one or several horizontal sections, vertical sections, slanted sections, and/or curves. It is necessary that the reference curve be a continuous line for associating luma values of different power-saving lumas to different display luma values to maintain an expected brightness gradient of the original frame.

Figure 7:
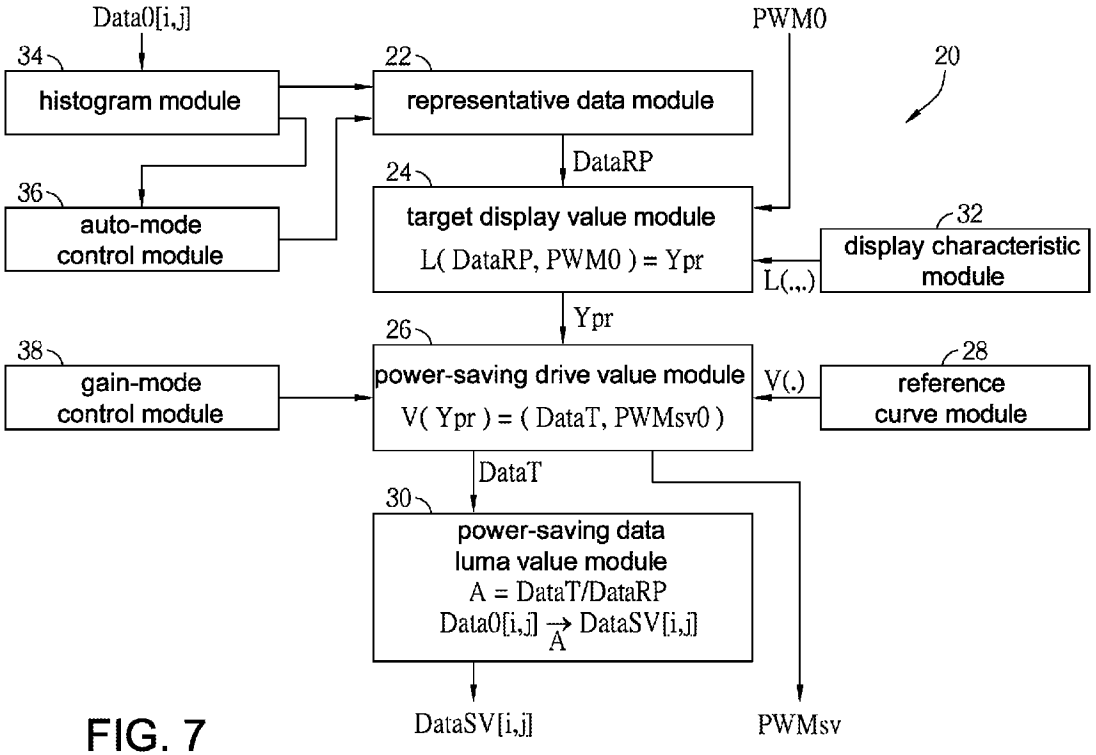
FIG. 7 is a schematic diagram of an apparatus according to an embodiment of the present invention.

FIG. 7 shows a schematic diagram of an apparatus 20 according to an embodiment of the present invention. The apparatus 20 performs the process 100 for implementing the power-saving display technique for the display 10 in FIG. 1. The apparatus 20 comprises a representative data luma module 22, a target display luma value module 24, a power-saving drive value module 26, a reference curve module 28, a power-saving data luma value module 30, a display characteristic module 32, a histogram module 34, an auto-mode control module 36, and a mode control module 38. The representative data luma module 22, the target display luma value module 24, the power-saving drive value module 26, and the power-saving data luma value module 30 are coupled in series.

In the apparatus 20, the display characteristic module 32, coupled to the target display luma value module 24, accesses/provides the display characteristic function L. The display characteristic function L associates the luma value DataL of the input data luma DataIN and the drive value PWM of the input drive PWMin to the luma display value Y; that is, Y=L(DataL, PWMin). For example, before the display 10 is shipped out of the factory, the luma display values displayed by the display 10 with different luma values and different drives are measured by an optical apparatus to accordingly obtain the display characteristic L corresponding to the display 10. Due to discrepancies in materials, manufacturing processes and/or assembly processes, display characteristics of different displays may vary. The reference curve 28, coupled to the power-saving drive value module 26, provides a characteristic curve V according to the display characteristic L of the display 10. The characteristic curve V associates the display luma value Y to a set of luma value DataL and drive PWM; that is, V(Y)=(DataL, PWM). As discussed with reference to FIG. 2, the threshold drive value PWM_th of the display 10 may be taken into consideration when establishing the characteristic curve V to eliminate light leakage. The threshold drive value PWM_th is also measured before the display 10 is shipped out of the factory. Similarly, due to discrepancies in materials, manufacturing processes and/or assembly processes, threshold drive value PWM_th corresponding to different displays may be different. Thus, the threshold drive value PWM_th may quantitatively represent the light leakage characteristics of individual displays.

The histogram module 34 is coupled to the representative data luma module 22 and the auto-mode control module 36. When displaying the frame 16 (FIG. 1), the histogram module 34 performs a histogram distribution according to the original data luma Data0[i, j] of the frame 16, e.g., the histogram distribution discussed in Step 104 and FIG. 3, to sequentially categorize the original data lumas Data0[i, j] of different pixels according to the luma values into a plurality of decremental bins h[1] to h[M]. According to statistical characteristics of the original data lumas Data0[i, j], the representative data luma module 22 is then allowed to provide the representative data luma DataRP.

As in the embodiment discussed in Step 104, the auto-mode control module 36 provides a concentration level according to the numbers of the original data lumas Data0[i, j] in the bins h[m] of the histogram. When the concentration level satisfies a predetermined concentration condition, the auto-mode control module 36 prompts the representative data luma module 22 to provide the representative data luma DataRP according to the maximum original data luma value Data0_max, i.e., the frame quality mode. When the concentration level fails to satisfy the concentration level, under the control of the auto-mode control module 36, the representative data luma module 22 sets the representative data luma DataRP to be no greater than the maximum original data luma value Data0_max, i.e., the power-saving mode, as described in the embodiment in FIG. 4.

The target display luma value module 24 identifies the target display luma value Ypr from the display characteristic L according to the original drive PWM0 and the representative data luma DataRP, as in Step 106. The power-saving drive value module 26 maps the target display luma value Ypr to the reference data DataT and the power-saving drive PWMsv0 according to the reference curve V, and also provides the power-saving drive PWMsv according to the power-saving drive PWMsv0, as in Step 108. The power-saving data luma value module 30 obtains the ratio A according to the relationship between the reference data DataT and the representative data luma DataRP, and amplifies the original data luma Data0 [i, j] according to the ratio A to provide the power-saving data luma DataSV[i, j], as in Steps 110 and 112. The display 10 then displays the frame 16 by respectively regarding the power-saving data luma DataSV[i, j] and the power-saving drive PWMsv as the input data luma DataIN[i, j] and the input drive PWMin.

The mode control module 38, coupled to the power-saving drive value module 26, provides a normal power-saving mode and at least one reinforced power-saving mode. In the normal power-saving mode, the power-saving drive value module 26 sets the power-saving drive PWMsv to equal the power-saving drive PWMsv0 under the control of the mode control module 38. In the reinforced power-saving mode, the power-saving drive value module 26 sets the power-saving drive PWMsv to equal the difference (PWMsv0−dPWM) between the power-saving drive PWMsv0 and a predetermined reduced drive dPWM under the control of the reinforced-mode control module 38, so as to reduce power consumption of the light source. The frame quality mode and the power-saving mode of the auto-mode control module 36 may be used in combination with the normal power-saving mode and the reinforced power-saving mode of the mode control module 38. For example, the frame quality mode is used in combination with the either the normal power-saving mode or the reinforced power-saving mode.

The apparatus 20 may be integrated into a display controller in the display 10, and modules of the apparatus 20 may be implemented by software, hardware, and/or firmware. For example, the histogram module 34 is realized by a hardware circuit. The auto-mode control module 36, the representative data luma module 22, the target display luma value module 24, the power-saving drive value module 26, and the power-saving luma value module 30 may be realized by a processor cooperating with corresponding codes. The display characteristic module 32 may be realized by a storage circuit for storing the display luma values Y=L(DataL, PWM) corresponding to different luma values DataL and different drive values PWM as a look-up table.

In conclusion, the present invention is capable of attending to both frame quality and power saving for modern display devices. More specifically, apart from being capable of maintaining appropriate brightness gradient for frame quality, the present invention also effectively reduces the power consumption of the light source and prevents light leakage caused by excessive power saving. The present invention may be applied to a display of a portable electronic device to prolong the power supply period of a battery set of the portable electronic device, and is also applicable to an audio-visual electronic equipment having a large-size panel to effectively reduce the high power consumption of the large-size panel.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for power-saving display, applied to a display comprising a display characteristic, the display characteristic associating a data luma value and a drive value to a target display luma value, the drive value relating to a light source brightness, the method comprising:

providing a threshold drive value according to a light leakage characteristic of the display;

providing a reference curve according to the threshold drive value, for associating the target display luma value to a plurality of sets of reference data luma values and reference drive values;

mapping a representative data luma value of a frame comprising a plurality of original data luma values and a corresponding original drive value to the target display luma value according to the display characteristic;

obtaining a power-saving data luma value and a power-saving drive value from the plurality of sets of reference data luma values and reference drive values associated with the reference curve; and displaying the frame by applying a relationship between the power-saving data luma value and the representative data luma value to each of the plurality of original data luma values.

2. The method according to claim 1, further comprising:
utilizing a maximum value of the original data luma values as the representative data luma value.

3. The method according to claim 1, further comprising:
performing a histogram distribution to decrementally categorize the original data luma values into a plurality of bins.

4. The method according to claim 3, further comprising:
selecting a plurality of representative bins, each corresponding to a representative number, wherein a number of the original data luma values accumulated from a highest bin to each of the representative bins matches the representative number corresponding to each of the representative bins; and
providing the representative data luma value according to the original data luma values in the highest bin to each of the representative bins.

5. The method according to claim 4, further comprising:
providing a quasi-representative data luma value for each of the representative bins according to the original data luma values in the highest bin to each of the representative bins; and
providing the representative data luma value according to the predetermined number of quasi-representative data luma values.

6. The method according to claim 5, wherein the quasi-representative data luma value is provided for each of the representative bins according to an average value or a smallest value of the original data luma values in the highest bin to each of the representative bins.

7. The method according to claim 3, further comprising:
providing a concentration level according to the number of the original data luma values in each of the bins;
when the concentration level satisfies a concentration condition, choosing a maximum value of the original data luma values as the representative data luma value; otherwise, choosing a value smaller than the maximum value of the original data luma values as the representative data luma value.

8. The method according to claim 1, further comprising:
providing a percentage according to a ratio of the power-saving luma value and the representative data luma value, and performing power-saving display of the frame according to a product of the percentage and each of the original data luma values.

9. The method according to claim 1, the display characteristic mapping a maximum luma value and the threshold drive value to a threshold display luma value, the method further comprising:
associating any target display luma value that is greater than the threshold display luma value to the maximum luma value according to the reference curve, and associating any target display luma value that is smaller than the threshold display luma value to the threshold drive value.

10. A method for power-saving display, applied to a display comprising a display characteristic, the display characteristic associating a data luma value and a drive value to a target display luma value, the drive value relating to a light source brightness, the method comprising:
providing a reference curve, for associating the target display luma value to a plurality of sets of reference data luma values and reference drive values;
mapping a representative data luma value of a frame comprising a plurality of original data luma values and a corresponding original drive value to the target display luma value according to the display characteristic;
obtaining a power-saving data luma value and a power-saving drive value from the plurality of sets of reference data luma values and reference drive values associated with the reference curve;
determining a power-saving mode;
reducing the power-saving drive value by a predetermined reduced drive value and modifying the power-saving data luma value according to the power-saving drive value and the reference curve when the power-saving mode is a reinforced power-saving mode; and
displaying the frame by applying a relationship between the power-saving data luma value and the representative data luma value to each of the plurality of original data luma values.

11. The method according to claim 10, further comprising:
utilizing a maximum value of the original data luma values as the representative data luma value.

12. The method according to claim 10, further comprising:
performing a histogram distribution to decrementally categorize the original data luma values into a plurality of bins.

13. The method according to claim 12, further comprising:
selecting a plurality of representative bins, each corresponding to a representative number, wherein a number of the original data luma values accumulated from a highest bin to each of the representative bins matches the representative number corresponding to each of the representative bins; and
providing the representative data luma value according to the original data luma values in the highest bin to each of the representative bins.

14. The method according to claim 13, further comprising:
providing a quasi-representative data luma value for each of the representative bins according to the original data luma values in the highest bin to each of the representative bins; and
providing the representative data luma value according to the predetermined number of quasi-representative data luma values.

15. The method according to claim 14, wherein the quasi-representative data luma value is provided for each of the representative bins according to an average value or a smallest value of the original data luma values in the highest bin to each of the representative bins.

16. The method according to claim 12, further comprising:
providing a concentration level according to the number of the original data luma values in each of the bins;
when the concentration level satisfies a concentration condition, choosing a maximum value of the original data luma values as the representative data luma value; otherwise, choosing a value smaller than the maximum value of the original data luma values as the representative data luma value.

17. The method according to claim 10, further comprising:
providing a percentage according to a ratio of the power-saving luma value and the representative data luma value, and performing power-saving display of the frame according to a product of the percentage and each of the original data luma values.

18. The method according to claim 10, further comprising:
providing a threshold drive value according to a light leakage characteristic of the display; and
providing the reference curve according to the threshold drive value.

19. The method according to claim 10, the display characteristic mapping a maximum luma value and the threshold drive value to a threshold display luma value, the method further comprising:

associating any target display luma value that is greater than the threshold display luma value to the maximum luma value according to the reference curve, and associating any target display luma value that is smaller than the threshold display luma value to the threshold drive value.

20. An apparatus for power-saving display, applied to a display comprising a display characteristic, the display characteristic associating a data luma value and a drive value to a target display luma value, the drive value relating to a light source brightness, the apparatus comprising:

a representative data luma module, for providing a representative data luma value of a frame comprising a plurality of original data luma values and a corresponding original drive value;

a reference curve module, for setting a threshold drive value according to a light leakage characteristic of the display, and providing a reference curve according to the threshold drive value for associating the target display luma value to a plurality of sets of reference data luma values and reference drive values;

a target display luma value module, for mapping the original drive value and the representative data luma value to the target display luma value according to the display characteristic;

a power-saving drive value module, for obtaining a power-saving data luma value and a power-saving drive value from the plurality of sets of reference data luma values and reference drive values associated with the reference curve; and a power-saving data luma value module, for providing a relationship according to the power-saving data luma value and the representative data luma value for power-saving display of the frame by applying the relationship to each of the plurality of original data luma values.

21. The apparatus according to claim 20, wherein the representative data luma module utilizes a maximum value of the original data luma values as the representative data luma value.

22. The apparatus according to claim 20, further comprising:

a histogram module, for performing a histogram distribution to decrementally categorize the original data luma values into a plurality of decremental bins.

23. The apparatus according to claim 22, wherein the representative data luma module selects a plurality of representative bins, each corresponding to a representative number, a number of the original data luma values accumulated from a highest bin to each of the representative bins matching the representative numbers corresponding to each of the representative bins; and the representative data luma module further provides the representative data luma value according to the original data luma values from the highest bin to each of the representative bins.

24. The apparatus according to claim 23, wherein the representative data luma module further provides a quasi-representative data luma value for each of the representative bins according to the original data luma values in the highest bin to each of the representative bins, and provides the representative data luma value according to the predetermined number of quasi-representative data luma values.

25. The apparatus according to claim 24, wherein the representative data luma module respectively provides the corresponding quasi-representative data luma value for each of the representative bins according to an average value or a smallest value of the original data luma values in the highest bin to each of the representative bins.

26. The apparatus according to claim 22, further comprising:

an auto-mode control module, for providing a concentration level according to the number of the original data luma values in each of the bins; and utilizing a maximum value of the original data luma values as the representative data luma value when the concentration level satisfies a concentration condition, or else utilizing a value smaller than the maximum value of the original data luma values as the representative data luma value.

27. The apparatus according to claim 20, wherein the power-saving drive value module provides a percentage according to a ratio of the power-saving luma value and the representative data luma value, and providing a product according to the percentage and each of the original data luma values for power-saving display of the frame.

28. The apparatus according to claim 20, wherein the display characteristic maps a maximum luma value and the threshold drive value to a threshold display luma value; and the reference curve module associates by the reference curve the target display luma value greater than the threshold display luma value to the maximum luma value, and associates by the reference curve the target display luma value smaller than the threshold display luma value to the threshold drive value.

* * * * *